US006517066B2

(12) United States Patent
Covert et al.

(10) Patent No.: US 6,517,066 B2
(45) Date of Patent: Feb. 11, 2003

(54) METHOD AND SYSTEM FOR PURGING AND PREPARING A PRINTER

(75) Inventors: David W. Covert, Ontario, NY (US); Jose A. Pená , Gilbert, AZ (US); Gary Roscoe, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/902,686

(22) Filed: Jul. 12, 2001

(65) Prior Publication Data

US 2003/0011122 A1 Jan. 16, 2003

(51) Int. Cl.[7] ..... B65H 5/26

(52) U.S. Cl. ..... 271/9.13; 271/265.01; 271/265.02; 198/358

(58) Field of Search ..... 198/358, 371.2; 271/264, 265.01, 265.02, 9.13, 9.01; 399/388

(56) References Cited

U.S. PATENT DOCUMENTS 3,592,333 A * 7/1971 Sullivan et al. ..... 198/371.2
3,703,725 A * 11/1972 Gomersall et al. ..... 198/358
5,110,115 A * 5/1992 Couper ..... 271/265.02
6,347,697 B1 * 2/2002 Ouellette et al. ..... 198/358

* cited by examiner

*Primary Examiner*—H. Grant Skaggs
(74) *Attorney, Agent, or Firm*—Oliff & Berridge, PLC

(57) ABSTRACT

A method and a system for controlling cycle up and cycle down operations of a printer device that includes a plurality of individual transport, where each transport defines a section of an overall path for the medium and performs a process relative to the medium as it passes therethrough. A sensor associated with each transport provides information indicative of its operation including a signal indicating whether or not a medium is present within its paper path section. A controller is operatively associated with the transports to receive such information produced by the sensor, and based thereon, to control the transports during cycle up and cycle down sequences.

17 Claims, 3 Drawing Sheets

FIG. 3
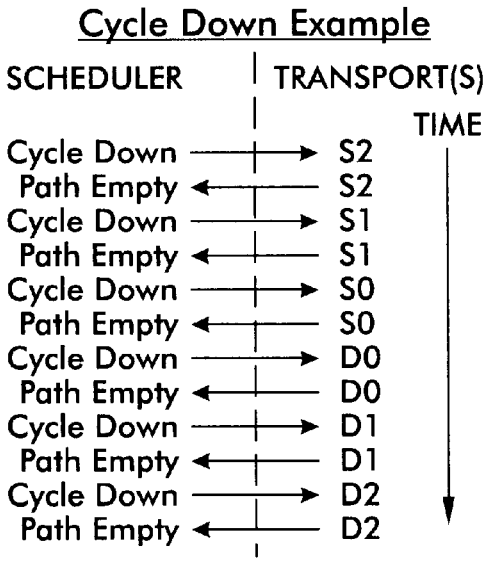
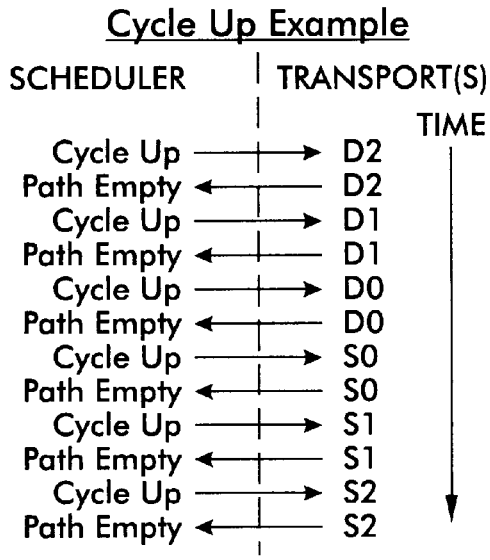
FIG. 4

METHOD AND SYSTEM FOR PURGING AND PREPARING A PRINTER

BACKGROUND OF THE INVENTION

This invention relates to printer devices, but more particularly to preparing a printer for efficiently cycling down and/or cycling up taking into account the medium transport speed.

Conventional printing machines having multiple modules use a fixed "dead" waiting period in cycling down without taking into account what is actually occurring in the machine or within the respective modules that make up the machine. For example and with reference to FIG. 1, a conventional cycle down scheme considers the machine 10 to be a collection of "nodes" 12 and coordinates the cycle down sequence by dead waiting periods. A primary reason for using a dead waiting period is to ensure that all paper or other medium has exited transport paths (e.g., stacker top transport) of the respective module or node. As shown in FIG. 1, a typical machine 10 may have four nodes with each having an associated, predetermined dead waiting period for paper to clear its path. The dead waiting periods must be changed upon a change in the paper path or a change in transport speed of the machine 10. Dead waiting periods are not heretofore known to take into account the particular location or speed of the paper in the paper path when initiating a shutdown or start-up sequence.

Accordingly, there is a need to provide a system and/or method of cycling the power of a printer up or down by controlling sections of the path which do not contain paper or other medium.

SUMMARY OF THE INVENTION

An object of the present invention is to fulfill at least the need mentioned above. In accordance with one principle of the present invention, the above and other needs are attained by a method of managing the path of a printable medium, e.g., paper path, in a printer. The method includes establishing a plurality of individual medium transports that each define a section of the path. At each transport, a determination is made as to when the path section thereof does or does not contain a medium, e.g., is empty. A transport is identified which has a path section that does not contain any printable medium. Based on the determination, the identified transport is then controlled so as to be cycled down or cycled up.

In accordance with another aspect of the invention, a system for managing a medium path of a printer includes a printer having a plurality of individual transports. Each transport defines a section of the path for the medium. A sensor is associated with each transport to determine when the path section thereof does or does not contain any medium and to provide a signal indicating that the path section is clear of any medium. A controller is operatively associated with the transports to receive the signal, and based on that signal, to control those transports that are clear of any medium in the path section thereof.

Other features and characteristics of the present invention, as well as the methods of operation and the functions of the related elements of the structure, the combination of parts will become more apparent upon consideration of the following detailed description and appended claims with reference to the accompanying drawings, all of which form a part of this specification.

BRIEF DESCRIPTION OF THE DRAWINGS

Reference is made to the attached drawings, wherein elements having the same reference numerals represent like elements throughout and wherein:

FIG. 3 illustrates a cycle down sequence of the printer of FIG. 2.

FIG. 4 illustrates a cycle up sequence of the printer of FIG. 2.

DESCRIPTION OF ILLUSTRATIVE EMBODIMENTS

Figure 1:
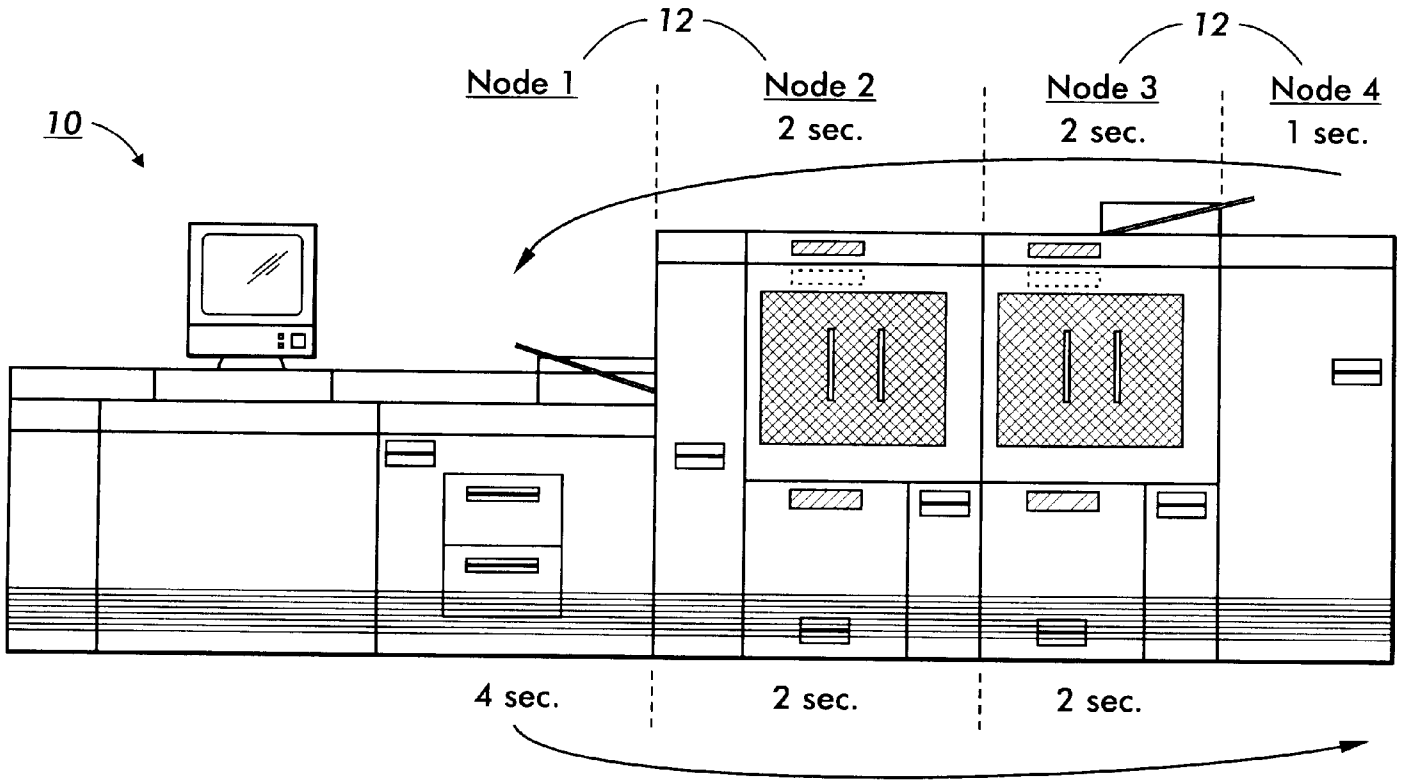
FIG. 1 PRIOR ART
FIG. 1 is a schematic illustration of a conventional printer having plural modules or nodes that may be cycled up and down, or powered up or down.
Figure 2:
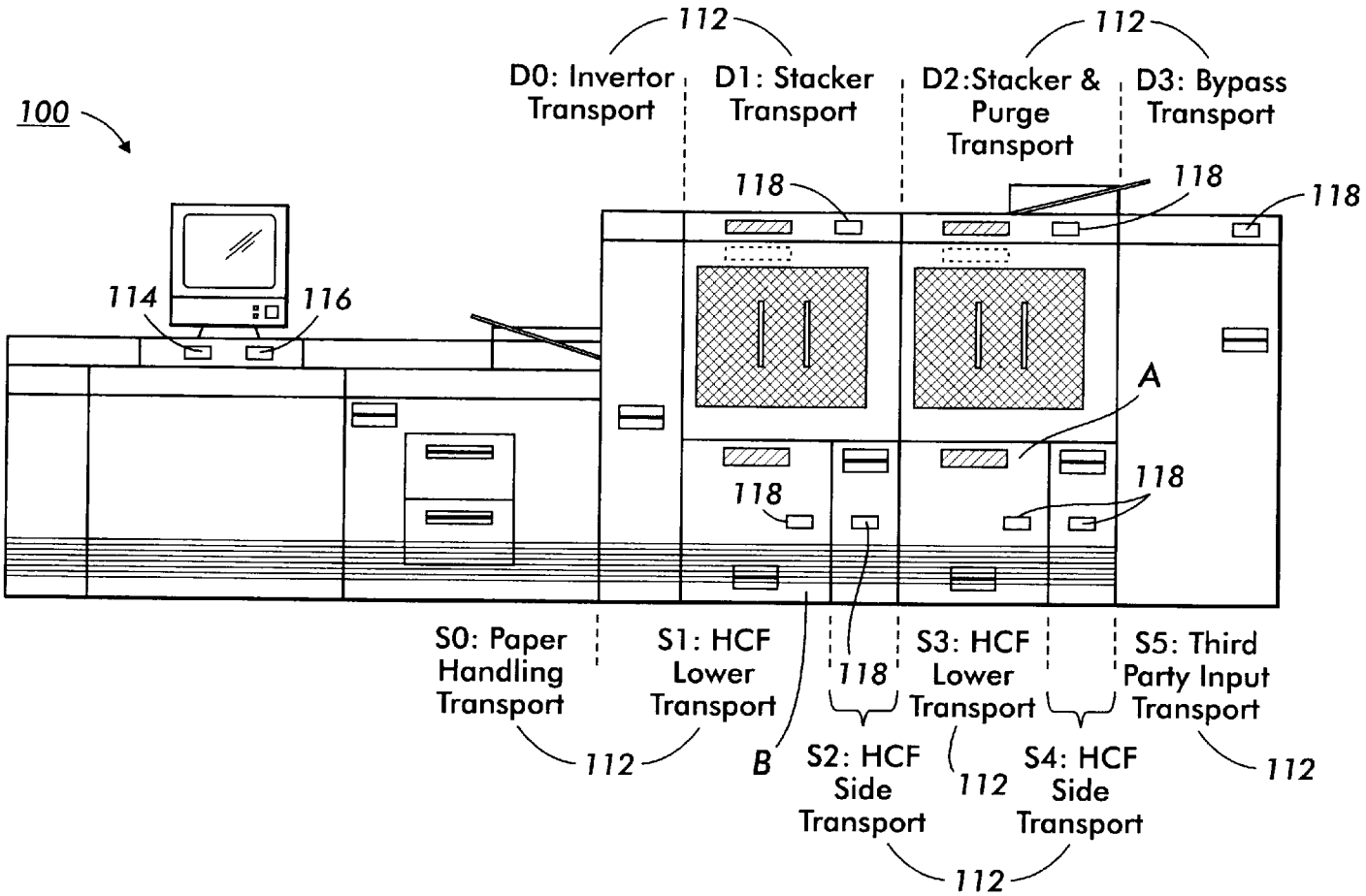
FIG. 2 is an illustration of a printer showing a transport scheme to cycle the printer up and down in accordance with principles of one embodiment of the present invention.

FIG. 2 shows an exemplary laser printer generally indicated at 100, which may incorporate features of the present invention. Printer 100 is operative to print on a printable medium, such as paper, and is of the type, for example, disclosed in U.S. Pat. No. 5,179,410, the contents of which are incorporated into the present specification by reference.

Printer 100 includes control software 114 and a controller or scheduler 116 that controls the printer modules and the respective paper paths of the printer 100. In a preferred arrangement, the printer is divided into modules or groups of modules, e.g., a transport, whose paper path must be controlled together as a single unit in order to maintain integrated control of the transports or modules. Thus, the basic definition of a "transport" is a section of an overall paper path through a printing machine that is or must be controlled as a single unit.

Printer 100 is broken down into a plurality of individual module transports 112. Each transport 112 defines a section of the overall paper path that is controlled as a single unit. Each transport 112 is constructed and arranged to determine, by use of a sensor 118, when its particular section of the path is empty or occupied. A typical paper sensor 118 comprises a moveable sensing vane connected to a switch. The switch may be mechanical, optical, or other type known in the art, and resides in one state during the presence of paper in the path and the opposite state in the absence of paper in the path. Paper moving through the paper path displaces the sensing vane, which causes the switch to change back and forth between states. By sensing a current state of the switch, as well as the length of time that the switch remains in that particular state, scheduler 116 can determine whether paper is present at that location, as well as how long the paper has been at that location. Alternatively, to measuring travel time of the paper through the transport, travel time may exist as pre-programmed information with the module or transport.

Each transport 112 conveys information to scheduler 116 indicates a maximum-time-to-purge value (e.g., the time needed to ensure that there are no sheets of paper in the therein) at power up of the printer 100. This time period, which may be a measured or predetermined quantity programmed into the transport, is provided in milliseconds. Measurement may occur in situ, or a service technician may supply the timing information. Scheduler 116 converts the supplied timing information to "pitches," which is based on the speed of a transport belt of the printer 100, as disclosed, for example, in U.S. Pat. No. 5,455,656, the contents of which are hereby incorporated by reference. Each pitch represents an individual image traveling through various states during the electrophotographic reproduction process.

Examples of various type of transports 112 are shown in FIG. 2, which illustrates six source transports that include a source zero (SO)—paper handling transport (S1)—High Capacity Feeder (HCF) lower transport for section B; source two (S2)—HCF side transport for section B; source three (S3)—HCF lower transport for section A; source four (S4)—HCF side transport for section A; and source five (S5)—third party input transport. In addition, four destination transports are shown, D0—inverter transport; D1—stacker transport; D2—stacker and purge transport and D3—bypass transport.

In a typical cycle down process, scheduler 116 instructs a furthest device (e.g., a transport 112) of the printer 100 to cycle down. When no paper is determined to reside in the paper path section defined by the respective transports 112, the scheduler 116 then instructs each transport to turn-off, starting from a destination device to the furthest feeder or source device. Other instructions may as well be issued depending on the needs of the printer device.

Assuming a print job involved tray 3 of section B of the printer 100 of FIG. 2, a cycle down sequence is illustrated in FIG. 3. The sequencing order of FIG. 3 allows the portion of the paper path to be sequenced off as soon as each section of the path becomes empty of paper. In certain printers, it is not desirable to begin the cycle down sequence until after a determination that there is no chance that the last sheet of paper could be aborted (and needs to be removed).

The cycle down sequence of FIG. 3 also handles a purge cycle down situation. However, in this instance, scheduler 116 must ensure that transports 112, up to and including the purge tray, are cycled up as soon as it is known a purge must be done. Then, these "extra" cycled-up transports 112 are added to the end of the list of transports 112 shown in FIG. 3 to be cycled down.

A typical cycle-up process is the reverse of the cycle down sequence shown in FIG. 3. Thus, a cycle up command is substituted for the cycle down command. When there is no purging to be performed, scheduler 116 need not wait for a path empty signal before cycling up the next transport 112; the scheduler 116 begins to schedule sheets. An example of a cycle up process is shown in FIG. 4. An optimization of the process assumes success and scheduling sheets begin at some time before the D2 time expires.

Thus, cycling up or down of the paper path (or other operation with respect to the printer device or the transports individually or collectively) is coordinated using "medium clear or occupied" state information provided by the individual transports 112 along with the transport's maximum-time-to-purge value. The maximum time to purge as provided by a transport 112 is sent to the scheduler 116 so as to have information relating to paper travel times. The scheduler 116 uses this information to cycle up a transport 112 that needs preparation time greater than other transports. Information including the maximum travel time or whether a medium in present in or absence from a transport can also be used by the scheduler 116 as an indication as to when to begin cycling down the various transports 112 that will not be needed for a certain print job.

Hence an advantage of the method provided by this aspect of the invention is to give scheduler 116 the ability to handle paper paths of different configurations without requiring changing of the scheduler 116 or additional programming. Prior schemes hard coded many paper path specifics into the scheduler 116 rather than having this information come from the source of the knowledge, e.g., transports 112. Since the transports 112 signal the controller that the section of the paper path is empty, a pre-programmed controller may be used to operate scheduler 116 since it will automatically adapt to the required scheduling sequence upon receipt of timing information from the respective modules. Such timing information may, for example, be automatically sent to the controller during power up of the respective modules. Thus, there is no need to change the code of scheduler 116 when the transport or its speed or paper path configuration is changed. Furthermore, the disclosed method reduces cycle up, cycle down and purge duration.

The foregoing illustrative embodiments have been shown and described for the purposes of illustrating the structural and functional aspects of the present invention, as well as illustrating methods of employing the various embodiments described herein, which may be modified or altered change without departing from the scope of the invention. Therefore, this invention includes all modifications and variations encompassed by the following claims.

What is claimed is:

1. A method of managing a path of a medium transported through a printer device during a cycle up or cycle down operation, the method including:

providing a plurality of transports of the printer device, each transport defining a paper path section, determining, for each transport, when the respective paper path section of the transports does not contain paper, identifying a transport from a plurality of transports having a paper path section that does not contain paper; and controlling the identified transport by powering the identified transport on or off according the determining and identifying.

2. The method of claim 1, further including:

at power-up of the printer, providing to a controller a maximum-time-to-purge value of each transport.

3. The method of claim 2, further including:

the controlling step using the maximum-time-to-purge value to determine when to begin cycling down of a transport that will not be needed in a certain operation of the printer.

4. The method of claim 2, further including:

the controlling step using the maximum-time-to-purge value to determine when to cycle up a transport that needs preparation time greater than other transports in a certain operation of the printer.

5. The method of claim 2, wherein the maximum-time-to-purge value is a millisecond value and the method includes converting the millisecond value to a pitch value.

6. The method of claim 1, wherein the determining step includes using a sensor associated with the transport to determine whether a paper path section of a transport does not contain paper.

7. The method of claim 1, wherein the controlling step includes cycling down the transport and powering the transport off.

8. The method of claim 1, wherein the controlling step includes cycling up the transport and powering the transport on.

9. The method of claim 1, wherein a controller performs the controlling step.

10. The method of claim 1, including:

using a pre-programmed controller to provide operation of the printer device regardless of a change in the paper path or in transport speed of the printer device.

11. A method of cycling up or down a printer that includes a path through which a medium is transported, the method including:

providing a plurality of individual transports of the printer, each transport defining a section of the paper path, determining, at a transport, when the paper path section thereof does not contain paper, identifying a transport from a plurality of transports having a paper path section that does not contain paper, and controlling the identified transport so as to control power supplied to the transport.

12. The method of claim 11, wherein the controlling step includes moving the transport to a cycle-down position and powering the transport off.

13. The method of claim 11, wherein the controlling step includes moving the transport to a cycle up position and powering the transport on.

14. A system for managing a paper path of a printer, the system comprising:

a printer including a plurality of individual transports, each transport defining a paper path section, a sensor associated with each transport to produces a signal indicative of when the paper path section is clear of paper, and a controller operatively associated with at least three transports to control each of the respective transports according to the signal.

15. The system of claim 14, wherein the controller is constructed and arranged to control the transports to cycle the printer down and turn the power of the transports off.

16. The system of claim 14, wherein the controller is constructed and arranged to control the transports to cycle the printer up and turn the power of the transports on.

17. A system for managing a paper path of a printer, the system comprising:

a printer including a plurality of individual transports, each transport defining a paper path section;

a sensor associated with each transport to produce a signal indicative of when the paper path section is clear of paper; and a controller that controls the transports based on instructions from a single computer program regardless of a change in the paper path or in transport speed of the printer.

* * * * *